US005398982A

United States Patent [19]

Watson, Jr.

[11] Patent Number: 5,398,982

[45] Date of Patent: Mar. 21, 1995

[54] DOOR SECURITY BAR

[76] Inventor: Larry Watson, Jr., 308 Lafayette Blvd., Long Beach, N.Y. 11561

[21] Appl. No.: 220,253

[22] Filed: Mar. 30, 1994

[51] Int. Cl.[6] ..... E05C 19/18

[52] U.S. Cl. ..... 292/259 R; 292/57; 292/338; 292/DIG. 15; 70/94

[58] Field of Search ..... 70/94; 292/338, 339, 292/259, 57, DIG. 15, 288, 289, 290, 297

[56] References Cited

U.S. PATENT DOCUMENTS

| | | | |
|---|---|---|---|
| 1,302,168 | 4/1919 | Hughes | 292/DIG. 15 X |
| 1,792,540 | 2/1931 | Johnson | 292/57 |
| 2,913,296 | 11/1959 | Martin | 292/259 X |
| 3,797,868 | 3/1974 | Carey | 292/57 |
| 3,806,179 | 4/1974 | Roessle | 292/259 |
| 3,919,807 | 11/1975 | Mefford | 292/259 X |
| 3,971,582 | 7/1976 | Walker | 292/259 R X |
| 4,050,723 | 9/1977 | Papadatos | 292/DIG. 15 X |
| 4,790,578 | 12/1988 | Barrera | 292/57 X |
| 4,858,972 | 8/1989 | Salyer | 292/338 |
| 5,340,172 | 8/1992 | Sweet | 292/338 X |

FOREIGN PATENT DOCUMENTS

| | | | |
|---|---|---|---|
| 215594 | 10/1909 | Germany | 292/259 |
| 250114 | 4/1926 | United Kingdom | 292/DIG. 15 |

*Primary Examiner*—Alexander Grosz
*Assistant Examiner*—Suzanne L. Dino
*Attorney, Agent, or Firm*—Alfred M. Walker

[57] ABSTRACT

A security door bar safety device elongated rod has a main extension portion having a distal end insertable within a hole within a floor adjacent to the door, and an arcuate handle end at a proximal end of said main extension portion. The arcuate handle end has extending downward therefrom a further partial extension, which is rotatable within a ferrule bar sleeve portion mounted adjacent to said door. The further partial extension portion is movable rotatably about the extension portion within the ferrule sleeve from a position of non-use to a locking position, wherein the main extension portion extends vertically parallel to said further partial extension portion.

5 Claims, 2 Drawing Sheets

DOOR SECURITY BAR

FIELD OF THE INVENTION

The present invention relates to a security bar for locking swinging doors in place.

BACKGROUND OF THE INVENTION

Various attempts have been made to lock swinging doors in place. U.S. Pat. No. 1,723,007 of Bittorf describes a security device wherein a sliding locking bolt is prevented from being pried upwardly from the outside by a restricting notch in double cam piece. The sliding bolt and bracket is attached to the door itself, thus increasing the weight of the door.

Moreover, U.S. Pat. No. 1,302,409 of Murphy describes a door security device which is also secured to the face of a door, thus adding unnecessary weight to the door. In Murphy '409, a sliding bolt moves down to lock in place within a groove within the floor adjacent to the door.

Both the Bittorf '007 and Murphy '409 patents have the disadvantages of increasing the weight upon the door, thus interfering with the ease of swinging the door open and closed. In addition, the attached bolt and brackets constitute protrusions, which may strike a user's leg during the process of opening and closing the door.

OBJECTS OF THE INVENTION

It is an object of the present invention to provide a door security bar device which easily locks the door closed, but which does not encumber the door with extra weight.

It is a further object of the invention to provide a security bar having an arcuate top and a downward extension portion which is rotatably slidable within a bar sleeve.

It is yet another object to provide a door security bar wherein the bar sleeve is attached to a door jam or a wall so that the security door bar is flush against a door.

It is yet another object to provide a door security bar device which provides a secure strength against intruders.

It is yet another object to provide a door security bar which is easily slid up from a recess hole in the floor and which is rotated about the sleeve to a opposite position of rest against the door jam or wall.

It is a further object to provide a door security bar which swings to in a position of rest away from the door and against the door jam or wall, thereby not encumbering the door with extra weight and noise upon the opening of the door.

It is yet another object to provide a door security bar which provides a storage of the bar away from the door, which is locked by the bar.

It is yet another object to provide a door bolt fixture which does not encumber the door itself with extra weight.

It is a further object to provide a door security device which is slidable toward and away from the door and which is held in place by a mounted ferrule sleeve within which the security bar rotates from a position of use to the position of rest.

It is yet another object to provide a door security bar which includes a rotatable extension arm extending down from an arcuate top portion of the security bar, and which is easy to handle and grab so that the user's fingers may conveniently lift the bar by inserting the fingers under the arcuate portion of the top of the security bar, to lift the security bar up and away from a position of use to a position of rest away from the door.

It is a further object to provide a retaining means for the bar in the floor.

It is a further object to provide a door security bar which straddles the opening between a door and a door jam, thus preventing the opening of the door from the other side.

It is yet another object of the present invention to improve over the disadvantages of the prior art.

SUMMARY OF THE INVENTION

In keeping with these objects and others which will become apparent, the present invention includes a security door bar safety device, including an elongated rod. The rod has a main extension portion having a distal end insertable within a hole within a floor adjacent to the door, and an arcuate handle end at a proximal end of said main extension portion. The arcuate handle end has extending downward therefrom a further partial extension, which is rotatable within a ferrule bar sleeve portion mounted adjacent to the door. The further partial extension portion is movable rotatably about the extension portion within the ferrule sleeve, from a position of non-use to a locking position, wherein the main extension portion extends vertically parallel to said further partial extension portion.

The bar sleeve is attached to a door jam or a wall so that the security door bar is flush against a door. The bar slides into a hole or a flange metal cup to receive the bar in the floor at an approximately depth of approximately two inches.

In order to provide a secure strength against any intruders, the bar is generally at its circumference about 2 inches round, or approximately $\frac{2}{3}$ inch in diameter and is roughly thirty four inches tall.

When not at use, the bar is easily slid up from the recess or hole in the floor and is rotated about the sleeve to a opposite position of rest against the door jam or wall where it is inserted in a second recess or hole in the floor adjacent to the door jam or wall.

The present invention is preferable over the prior art patented devices, such as Bittorf '007 and Murphy '409, because the door security bar swings to a position of rest away from the door and against the door jam or wall, thereby not encumbering the door with extra weight and noise upon the opening of the door.

The bar is held in a position of rest within the recess, which may be a flanged metal cup extending below the surface of the floor, but above the bottom of the door.

Another benefit of the present invention is that it provides for an easy swing away of the locking bar, and provides a storage of the bar away from the door, which is locked by the bar.

In contrast to the door security device of the present invention, the Bittorf '007 device is for a door bolt fixture upon a door, including an elongated door bolt having a right angle handle and a cam surface bracket for supporting the bolt. The bolt is repositioned by a cam surface where it swung away and up from a position of use into a position of rest.

However, the door bolt fixture of Bittorf '007 encumbers the door itself with extra weight, since both in the position of use and a position of rest, the door bolt of Bittorf '007 is suspended by and against the door, whether engaged within the floor or held up in a position of non-use, when there is clearance below the bottom of the door.

In the present invention, the door, which is opened by swinging, may be held fastened securely in a closed position by the door security bar resting mounted flush against the door. The security bar is slidable toward and away from the door and is held in place by a mounted ferrule sleeve within which the door security bar rotates from a position of use to a position of rest.

The door security bar of the present invention includes a rotatable extension arm extending down from an arcuate top portion of the door security bar. The rounded arcuate portion makes the security bar easy to handle and grab, so that the user's fingers may conveniently lift the bar by inserting the fingers under the arcuate portion of the top of the security bar, to lift the security bar up and away from a position of use to a position of rest away from the door.

The door security bar is held in place within a retaining means in the floor, such as a recessed hole or a flanged metal cup, approximately 2 inches deep in the floor, adjacent to the door.

The holding member for the bar includes a rigid ferrule sleeve which is mounted by conventional mounting means, such as a bracket with screws, to the door jam or wall. It provides a generally cylindrical recess within reach of the downwardly extending extension portion of the security door bar, which is rotatably placed therein.

When the bar is in a locked position, it is held against the door in the locking position, and the bar straddles the opening between the door and the door jam, thus preventing the opening of the door from the other side.

It is noted that there is a minimal distance, preferably 2½ inches, between the handle portion of the security door bar and the main portion of the security door bar main portion. This is to permit the arcuate portion and the downward extension portion of the security door bar to be placed flush against the door with a strong locking force.

When in use, the security door bar is moved in an upward manner, and is lifted slightly, to release it from the mounted flanged mounted cup or floor hole, and the door security bar is rotated to a position of rest on the side of the bar sleeve sheath away from the door. A further storage flange metal cup or floor hole is provided adjacent to the door jam during rest, at a point on the floor equidistant and opposite from the hole of the flange metal cup for insertion of the bar during use.

The extension arm of the security door bar moves slidably within the ferrule sleeve, so it can be easily and smoothly moved by a person without exertion of much strength. Because the entire length of the main extension portion of the door security bar is held against the door, the door is held firmly and securely in place against intruders and it cannot be moved from its locking position by pushing against the door.

When the door security bar is to be moved from the locking position to permit opening the door, the arcuate top portion is lifted and rotated away from the door and moved up out of the floor hole or flange metal cup. When fully withdrawn, the security bar is rotated to the position of non-use where it is held in place within by the further second floor hole or mounted ferrule sleeve sheath.

In contrast to the prior art of Bittorf '007 and Murphy '409, the security door bar of the present invention is removed completely away from the door during position of non-use. Moreover the door security bar is easily movable and comfortable to grasp due to arcuate rounded top handle portion for the user to grasp and lift the security door bar from a position of use to a position of non-use.

DESCRIPTION OF THE DRAWINGS

The invention can best be understood from the following drawings, in which.

DETAILED DESCRIPTION OF THE DRAWINGS

Figure 1:
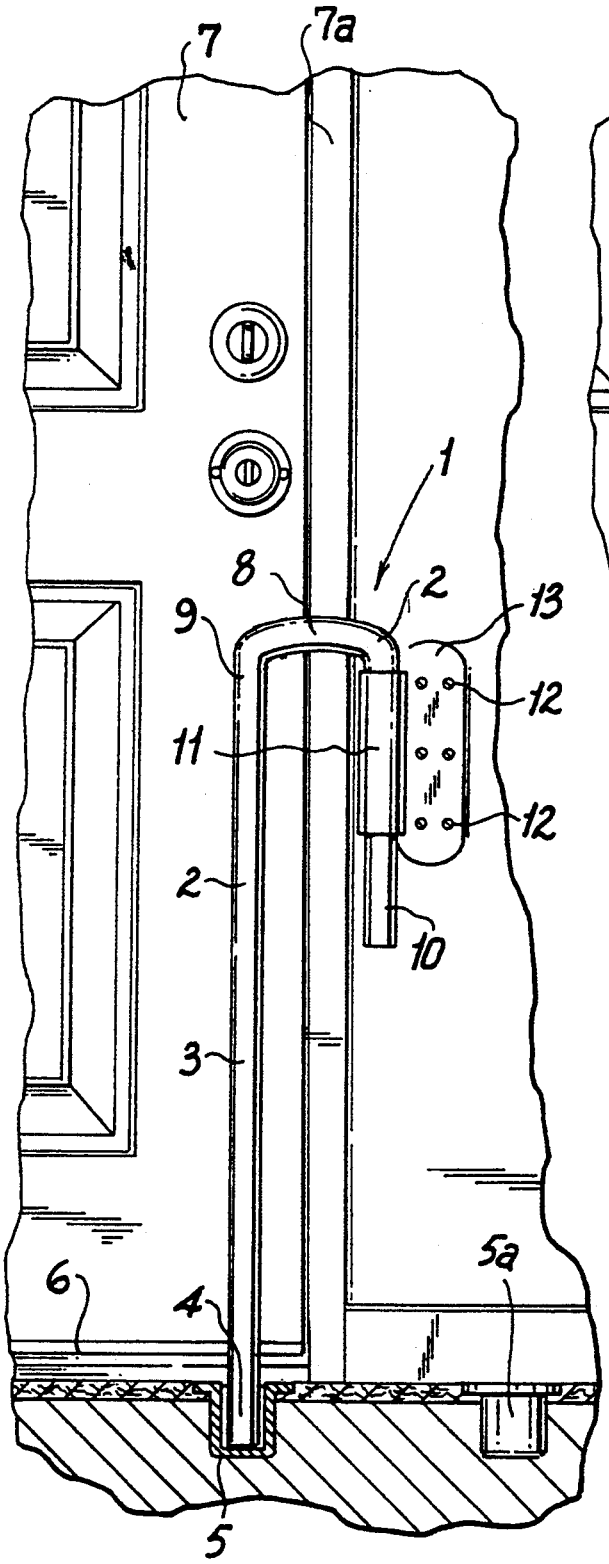
FIG. 1 is a front elevational view of the door security bar of the present invention in a position of use.
Figure 2:
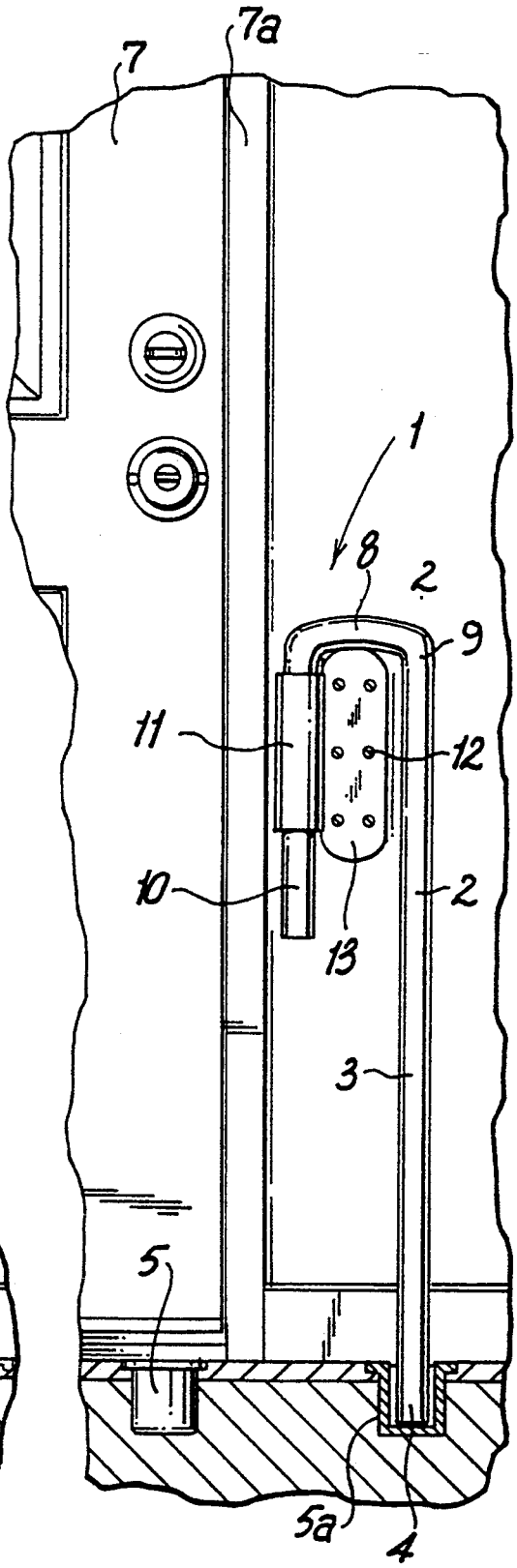
FIG. 2 is a front elevational view of the door security bar of the present invention in a position of non-use.
Figure 5:
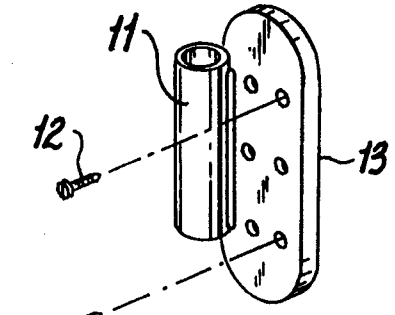
FIG. 5 is a closeup perspective view of the holding sleeve portion of the present invention.
Figure 6:
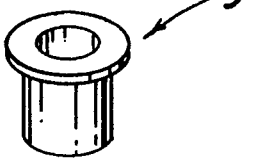
FIG. 6 is a closeup perspective view of the retaining cup of the present invention.
Figure 4:
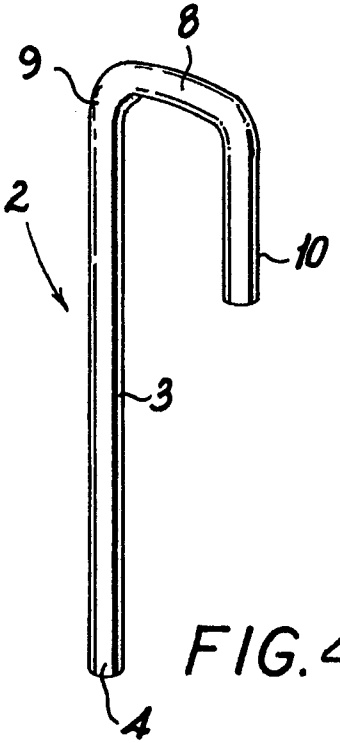
FIG. 4 is a closeup perspective view of the bar position of the present invention.

As shown in FIGS. 1–6, a security door bar safety device 1 includes an elongated rod or bar 2 having a main extension portion 3. Main extension portion 3 has a distal end 4 insertable within a hole 5 within floor 6 adjacent to a door 7. Bar 2 also includes an arcuate handle end 8 at a proximal end 9 of main extension portion 3. Arcuate handle end 8 has extending downward therefrom a further partial extension 10. Partial extension 10 is rotatable within a ferrule bar sleeve portion 11 mounted adjacent to the door 7, by an attaching means 12, such as screws or bolts, within mount 13. Further partial extension portion 10 is movable rotatably about within said ferrule sleeve 11 from a position of non-use to a locking position, wherein main extension portion 3 extends vertically parallel to further partial extension portion 10 against door jam or wall *7a*.

When not at use, main extension portion 3 of bar 2 is easily slid up from recess 5 in floor 6, and is rotated within ferrule sleeve 11 to a opposite position of rest against door jam or wall *7a*, and it is inserted in a second recess or hole *5a*.

Bar 2 swings to in a position of rest away from door 7 and against the door jam or wall *7a*, thereby not encumbering door 7 with extra weight and noise upon the opening of door 7.

Therefore, door 7, which is opened by swinging, may be held fastened securely in a closed position by door security bar 2, when bar 2 is mounted flush against door 7. Door security bar 2 is slidable toward and away from door 7 and is held in place by mounted ferrule sleeve 11 within which door security bar 2 rotates from a position of use to a position of rest.

Door security bar 2 includes rotatable extension arm 10 extending down from an arcuate top portion 8 of door security bar 2. Rounded arcuate portion 8 makes door security bar 2 easy to handle and grab so that the user's fingers may conveniently lift bar 2 by inserting the fingers under arcuate portion 8 of the top of door security bar 2, to lift door security bar 2 up and away from a position of use to a position of rest away from door 7.

Ferrule bar sleeve 11 includes rigid ferrule sleeve 11 which is mounted by conventional mounting means 13 to door jam or wall 7*a*. Sleeve 11 provides a cylindrical recess 11*a* within reach of downwardly extending extension portion 10 of door security bar 2, which is rotatably placed therein.

When bar 2 is in a locked position, it is held against door 7, and bar 2 straddles the opening between door 7 and door jam 7*a*, thus preventing the opening of door 7 from the other side of door 7 away from door security bar 2.

Figure 3:
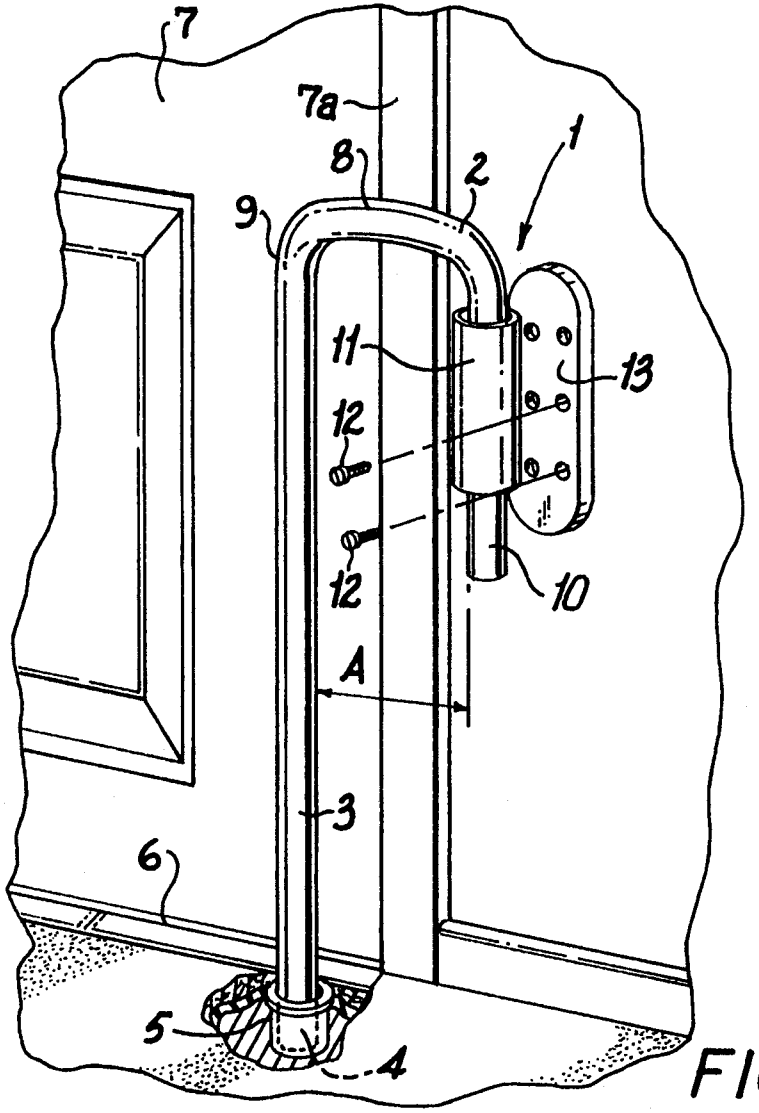
FIG. 3 is a closeup front perspective view of the device as in FIG. 2.

As shown in FIG. 3, there is shown a minimal distance "A" preferably 2½ inches, between further extension portion 10 of door security bar 2 and main portion 3 of the security door bar 2. This is to permit further extension portion 10 of door security bar 2 to be placed flush against door 7 with a strong locking force.

When in use, door security bar 2 is moved in an upward manner, and is lifted gently, to release bar 2 from recess 5, such as mounted flanged cup 5 from floor 6. Door security bar 2 is rotated to a position of rest on the side of ferrule bar sleeve 11 away from door 7. Further recess 5*a*, such as a flanged metal cup, is provided adjacent to door jam 7*a* during rest, at a point on floor 6 which is equidistant to and opposite from recess hole 5, such as a flanged cup, for insertion of door security bar 2 during use.

Extension arm portion 10 of door security bar 2 moves slidably within ferrule sleeve 11, so bar 2 can be easily and smoothly moved by a person without exertion of much strength. Because the entire length of main extension portion 3 of door security bar 2 is held against door 7, door 7 is held firmly and securely in place against intruders and it cannot be moved from its locked position by pushing against the door 7.

When door security bar 2 is to be moved from the locking position to permit opening of door 7, arcuate top portion 8 is lifted and rotated away from door 7 and is moved up out of recess hole 5 within floor 6. When fully withdrawn, door security bar 2 is rotated to a position of non-use, where it is held in place within by further second floor hole recess 5*a*.

Thus, the door security bar device of the present invention provides a novel, easily movable locking bolt to lock a door in place, while not encumbering the door with extra weight.

It is further noted that other modifications may be made to the present invention, without departing from the spirit and scope of the present invention as defined in the claims.

I claim:

1. A door security bar safety device comprising an elongated rod having a main extension portion having a distal end insertable within a recess hole within a floor adjacent to a door, a handle end being at a proximal end of said main extension portion, said handle end having extending downward therefrom a further partial extension portion, said further partial extension portion rotatable within a ferrule sleeve bar portion mounted spaced apart from and adjacent to said door, said further partial extension portion movable within said ferrule sleeve from a position of non-use to a locking position.

2. The door security bar safety device as in claim 1, wherein said handle further comprises an arcuate portion attached to said main extension portion, said arcuate portion being attachable to said further partial extension portion, said further partial extension portion being parallel to said main extension portion, said further partial extension portion being rotatable within said ferrule sleeve.

3. A door security bar safety device comprising an elongated rod having a main extension portion having a distal end insertable within a recess hole within a floor adjacent to a door, said elongated rod further having an arcuate handle end at a proximal end of said main extension portion, said arcuate handle end having extending downward therefrom a further partial extension portion, said further partial extension portion rotatable within a ferrule sleeve mounted spaced apart from and adjacent to said door, said further partial extension portion movable rotatably about said main extension portion within said ferrule sleeve from a position of non-use to a locking position, wherein said main extension portion extends vertically parallel to said further partial extension portion.

4. The door security bar safety device as in claim 3, wherein said main extension portion is insertable within a further recess hole, said further recess hole being spaced apart from a wall, against which said wall said door is closable.

5. The door security bar safety device as in claim 4, wherein said recess hole is spaced apart from said further recess hole.

* * * * *